US010883372B2

(12) United States Patent
Ferber et al.

(10) Patent No.: US 10,883,372 B2
(45) Date of Patent: Jan. 5, 2021

(54) GAS TURBINE COMPONENT

(71) Applicant: GENERAL ELECTRIC TECHNOLOGY GmbH, Baden (CH)

(72) Inventors: Joergen Ferber, Wutöschingen (DE); Petr Vitalievich Laletin, Moscow (RU)

(73) Assignee: General Electric Technology GMBH, Baden (CH)

( * ) Notice: Subject to any disclaimer, the term of this patent is extended or adjusted under 35 U.S.C. 154(b) by 685 days.

(21) Appl. No.: 15/114,005

(22) PCT Filed: Jan. 26, 2015

(86) PCT No.: PCT/EP2015/051448
§ 371 (c)(1),
(2) Date: Jul. 25, 2016

(87) PCT Pub. No.: WO2015/113925
PCT Pub. Date: Aug. 6, 2015

(65) Prior Publication Data

US 2016/0341047 A1 Nov. 24, 2016

(30) Foreign Application Priority Data

Jan. 30, 2014 (RU) ..... 2014103219

(51) Int. Cl.
*F01D 5/18* (2006.01)
*F01D 9/04* (2006.01)
*F01D 25/12* (2006.01)

(52) U.S. Cl.
CPC ..... *F01D 5/186* (2013.01); *F01D 5/18* (2013.01); *F01D 9/041* (2013.01); *F01D 25/12* (2013.01);
(Continued)

(58) Field of Classification Search
CPC ..... F01D 5/189; F01D 5/188; F01D 5/186; F01D 5/187; F01D 5/18; F01D 5/147;
(Continued)

(56) References Cited

U.S. PATENT DOCUMENTS 3,005,496 A 10/1961 Nichols
3,045,965 A 7/1962 Bowmer
(Continued)

FOREIGN PATENT DOCUMENTS

CN 1950589 A 4/2007
CN 102971494 A 3/2013
(Continued)

OTHER PUBLICATIONS

Office Action (First) dated Apr. 5, 2017, by the Chinese Patent Office in corresponding Chinese Patent Application No. 201580006655.2 and an English translation of the Office Action. (17 pgs).
(Continued)

*Primary Examiner* — Woody A Lee, Jr.
*Assistant Examiner* — Justin A Pruitt
(74) *Attorney, Agent, or Firm* — Armstrong Teasdale LLP

(57) ABSTRACT

A gas turbine component, for forming part of a stage of the turbine, operable to change cooling scheme, includes an airfoil profiled section, a cooling passageway, film holes and interchangeable connectors. The profiled section includes pressure and suction sides joined together at chordally opposite leading and trailing edges. The cooling passageway extends between the pressure and suction sides along the leading edge to enabling cooling fluid to flow therefrom. The film holes are configured on the cooling passageway to enable the flow of a portion of the cooling fluid to a portion of the profiled section. The interchangeable connectors configured to the cooling passageway, one at a time, to
(Continued)

change the cooling scheme. An insert may also be provided to close and open the film holes.

17 Claims, 4 Drawing Sheets

(52) U.S. Cl.
CPC ..... *F05D 2220/32* (2013.01); *F05D 2230/51* (2013.01); *F05D 2230/80* (2013.01); *F05D 2240/12* (2013.01); *F05D 2240/15* (2013.01); *F05D 2240/30* (2013.01); *F05D 2260/202* (2013.01); *F05D 2270/303* (2013.01)

(58) Field of Classification Search
CPC ..... F01D 9/041; F01D 25/12; F02C 7/141; F02C 7/18; F05D 2220/32; F05D 2230/51; F05D 2240/12; F05D 2240/121; F05D 2240/122; F05D 2240/15; F05D 2240/30; F05D 2240/303; F05D 2240/304; F05D 2260/201; F05D 2260/202; F05D 2270/303
USPC ..... 416/97 R
See application file for complete search history.

(56) References Cited

U.S. PATENT DOCUMENTS

| | | | | |
|---|---|---|---|---|
| 3,807,892 | A * | 4/1974 | Frei | F01D 5/187 415/116 |
| 3,937,588 | A * | 2/1976 | Kisslan | F02C 9/20 415/17 |
| 5,726,348 | A | 3/1998 | Draghi et al. | |
| 6,039,537 | A | 3/2000 | Scheurlen | |
| 7,273,347 | B2 | 9/2007 | Rathmann | |
| 7,708,229 | B1 | 5/2010 | Angle, II et al. | |
| 9,664,111 | B2 * | 5/2017 | Bogue | F02C 7/12 |
| 2006/0174620 | A1 * | 8/2006 | Albat | F02B 37/005 60/599 |
| 2007/0071593 | A1 | 3/2007 | Rathmann | |
| 2013/0104517 | A1 | 5/2013 | Correia | |
| 2013/0209231 | A1 | 8/2013 | Davis et al. | |
| 2014/0271101 | A1 * | 9/2014 | Slavens | F01D 5/187 415/1 |

FOREIGN PATENT DOCUMENTS

| | | |
|---|---|---|
| CN | 103089336 A | 5/2013 |
| JP | 2003-083001 A | 3/2003 |

OTHER PUBLICATIONS

International Search Report (PCT/ISA/210) dated Jun. 5, 2015, by the European Patent Office as the International Searching Authority for International Application No. PCT/EP2015/051448.
Written Opinion (PCT/ISA/237) dated Jun. 5, 2015, by the European Patent Office as the International Searching Authority for International Application No. PCT/EP2015/051448.

* cited by examiner

GAS TURBINE COMPONENT

BACKGROUND

Field of Endeavor

The present disclosure relates to a field of gas turbine engines, and, more particularly, to a turbine components, such as turbine blades or stator vanes, for forming part of a stage of the turbines.

Brief Description of the Related Art

Turbines are essentially utilized to convert gas energy firstly into mechanical energy, in the form of rotational energy, and then into electrical energy. Multiple rows, which are termed stages, of turbine blades or vanes are used to rotate a turbine shaft. Each turbine stage alternately consists of stationary and rotating components. The stationary components are rows of turbine vanes mounted to the inside of a turbine stator while the rotating components are rows of turbine blades mounted to a turbine rotor.

For operation of the turbine at high turbine stage, gas at high pressure and temperature enters the turbine axially and gradually moves from alternating stationary and rotating rows of vanes and blades to causes the turbine rotor to rotate and the gas to expand. In such high temperature and pressure environment, in which gas flowing over the turbine blades or vanes may be at a temperature close to, or even exceeding, the melting point of the material, such as a high temperature super-alloy, from which the turbine blade or vanes are made. It is known to cool turbine blades by providing within them passages which receive relatively cool air from, for example, the compressor of the engine. Additional cooling is achieved by providing cooling holes extending from the cooling passages within the blade or vanes to the external surface thereof, so that cooling air from the passages can emerge at the external surface and flow along that surface to provide film cooling.

However, while turbine operation at different temperature levels, such film cooling may not be required for durability reasons and hence to improve turbine efficiency by saving cooling air, the cooling scheme for the blades or vanes may be require to be changed. Conventionally, major changes in the cooling scheme may be done by changes in castings, which may be quite cumbersome, tedious and uneconomical.

Accordingly, it may be one of an essential requirement with respect to blades or vanes design and configurations in such turbine to be optimized to deal with the change in cooling scheme, in efficient manner so that required cooling scheme may be obtained easily in an economical and adaptable manner.

SUMMARY

The present disclosure describes gas turbine components, such as turbine blades or stator vanes, which will be presented in the following simplified summary to provide a basic understanding of one or more aspects of the disclosure which are intended to overcome the discussed drawbacks, but to include all advantages thereof, along with providing some additional advantages. This summary is not an extensive overview of the disclosure. It is intended to neither identify key or critical elements of the disclosure, nor to delineate the scope of the present disclosure. Rather, the sole purpose of this summary is to present some concepts of the disclosure, its aspects and advantages in a simplified form as a prelude to the more detailed description that is presented hereinafter.

An object of the present disclosure is to describe a turbine component, such as turbine blades or stator vanes, heat shields, to be optimized to deal the change in cooling scheme in efficient manner so that required cooling scheme may be obtained easily in an economical and adaptable manner Various other objects and features of the present disclosure will be apparent from the following detailed description and claims.

The above noted and other objects, in one aspect, may be achieved by a turbine component for forming part of a stage of a gas turbine to be operable to change cooling scheme thereof, the gas turbine component comprising:

an airfoil profiled section having a pressure side and a suction side joined together at chordally opposite leading and trailing edges;

at least one cooling passageway extending between the pressure side and the suction side along the leading edge, the at least one cooling passageway capable of enabling cooling fluid to flow therefrom;

a plurality of film holes extending between the at least one cooling passageway and an exterior of the airfoil profiled section, the plurality of film holes capable of directing at least a portion of the cooling fluid from the at least one cooling passageway to flow over a portion of the airfoil profiled section; and interchangeable connectors, configured to the at least one cooling passageway, one at a time, to change the cooling scheme by changing the flow of the cooling fluid in coordination with the opening and closing of the plurality of film holes.

This together with the other aspects of the present disclosure, along with the various features of novelty that characterize the present disclosure, is pointed out with particularity in the present disclosure. For a better understanding of the present disclosure, its operating advantages, and its uses, reference should be made to the accompanying drawings and descriptive matter in which there are illustrated exemplary embodiments of the present disclosure.

BRIEF DESCRIPTION OF THE DRAWINGS

The advantages and features of the present disclosure will be better understood with reference to the following detailed description and claims taken in conjunction with the accompanying drawing, wherein like elements are identified with like symbols, and in which:

FIGS. 1A to 1C illustrates an example of various views of a turbine component, such as turbine blade or stator vane, having one of a interchangeable connector, wherein FIG. 1A is a perspective view, FIG. 1B is cross-section view along B-B of FIG. 1A, and FIG. 1C is a top view of FIG. 1A along A, in accordance with an exemplary embodiment of the present disclosure;

FIGS. 2A to 2C illustrates an example perspective view of a turbine component, such as turbine blade or stator vane, having one of another interchangeable connector, wherein FIG. 2A is a perspective view, FIG. 2B is cross-section view along C-C of FIG. 2A, and FIG. 2C is a top view of FIG. 2A along D in accordance with an exemplary embodiment of the present disclosure;

Like reference numerals refer to like parts throughout the description of several views of the drawings.

DETAILED DESCRIPTION OF THE PRESENT DISCLOSURE

For a thorough understanding of the present disclosure, reference is to be made to the following detailed description, including the appended claims, in connection with the above described drawings. In the following description, for purposes of explanation, numerous specific details are set forth in order to provide a thorough understanding of the present disclosure. It will be apparent, however, to one skilled in the art that the present disclosure can be practiced without these specific details. In other instances, structures and apparatuses are shown in block diagrams form only, in order to avoid obscuring the disclosure. Reference in this specification to "one embodiment," "an embodiment," "another embodiment," "various embodiments," means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but may not be of other embodiment's requirement.

Although the following description contains many specifics for the purposes of illustration, anyone skilled in the art will appreciate that many variations and/or alterations to these details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure. Further, the terms "a" and "an" herein do not denote a limitation of quantity, but rather denote the presence of at least one of the referenced item.

Figure 1A:
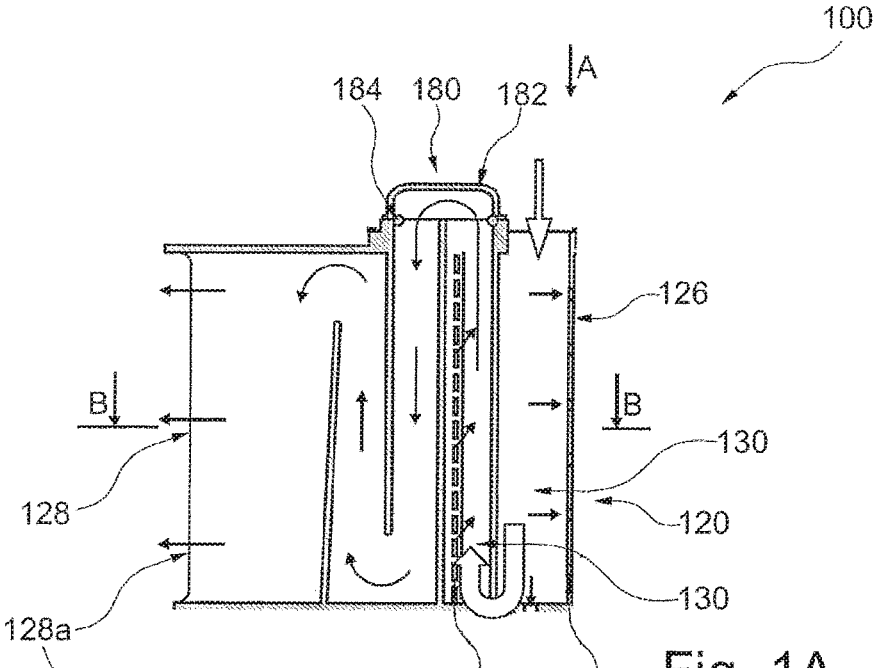
Figure 1B:
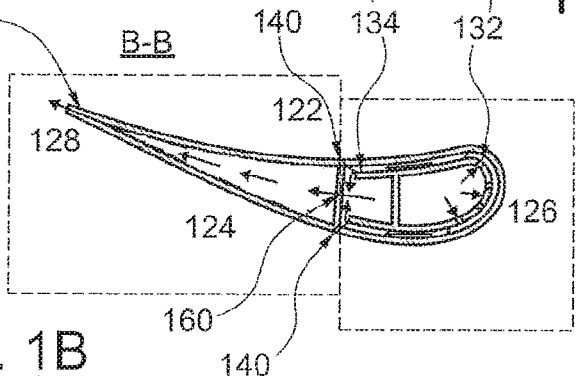
Figure 1C:
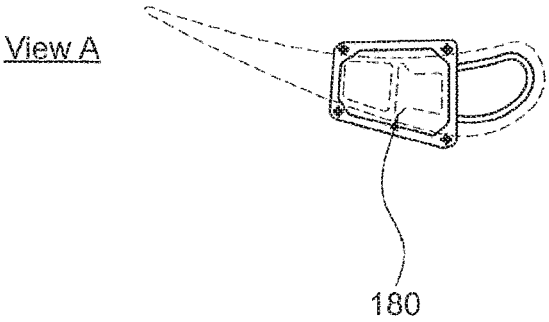
Figure 2A:
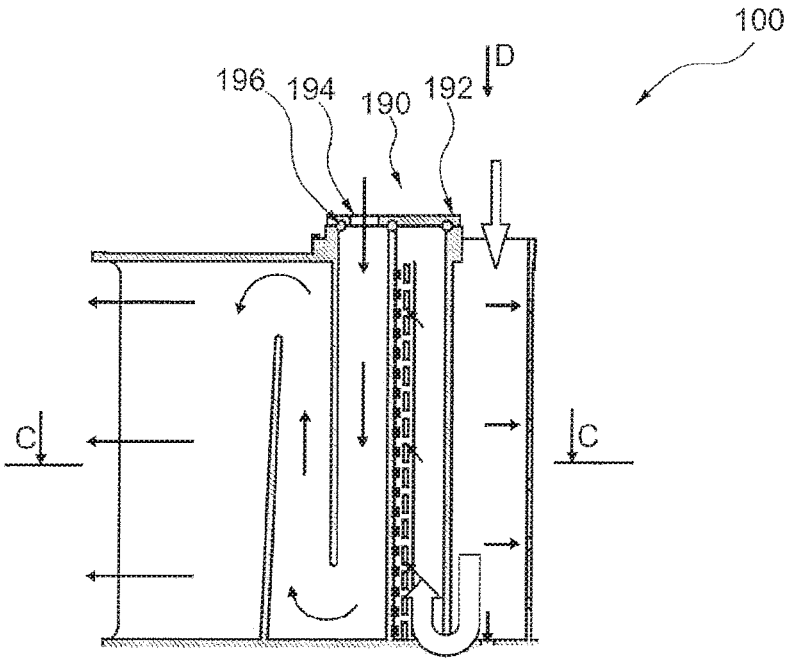
Figure 2B:
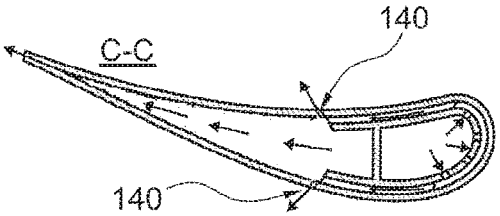
Figure 2C:
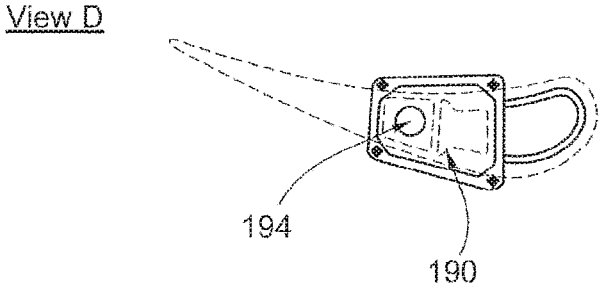
Figure 3:
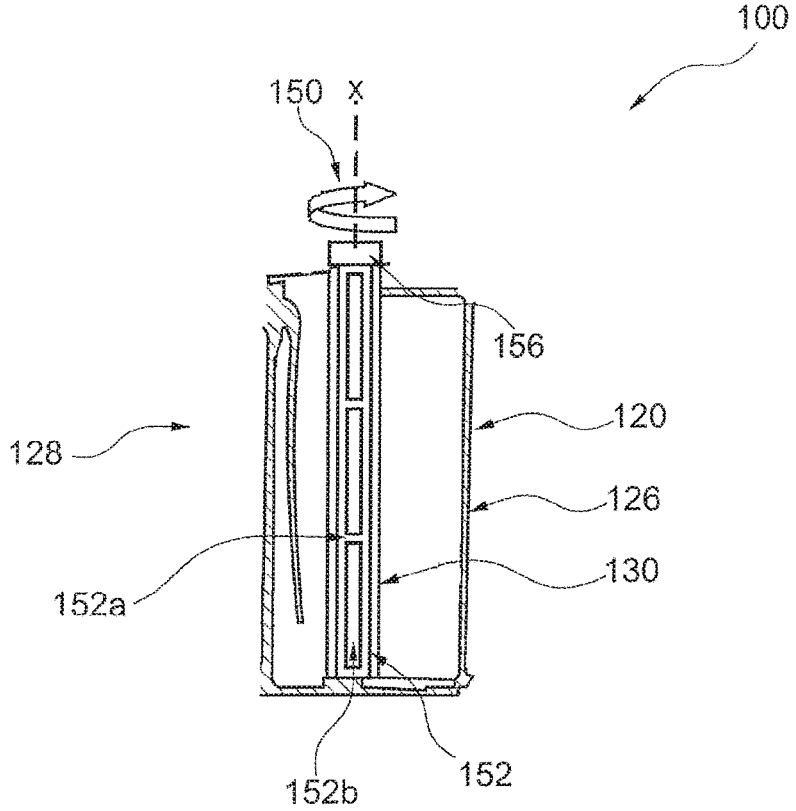
FIG. 3 illustrates an example perspective view of a turbine component with an insert, in accordance with an exemplary embodiment of the present disclosure.
Figure 4A:
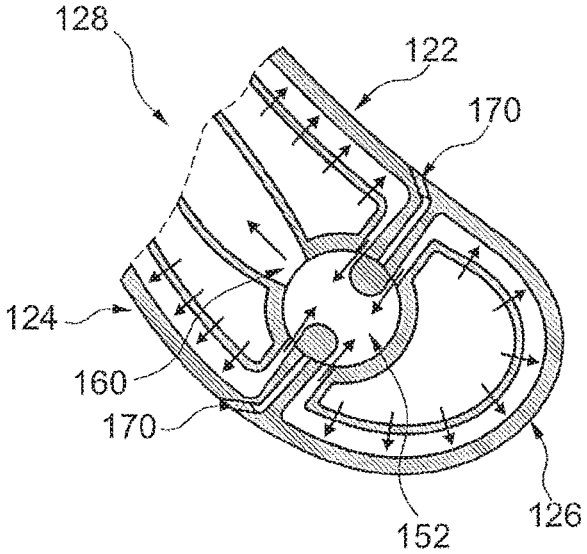
FIGS. 4A and 4B illustrate top views of an inner platform with the insert as per the turbine component of FIG. 3, in accordance with an exemplary embodiment of the present disclosure.
Figure 4B:
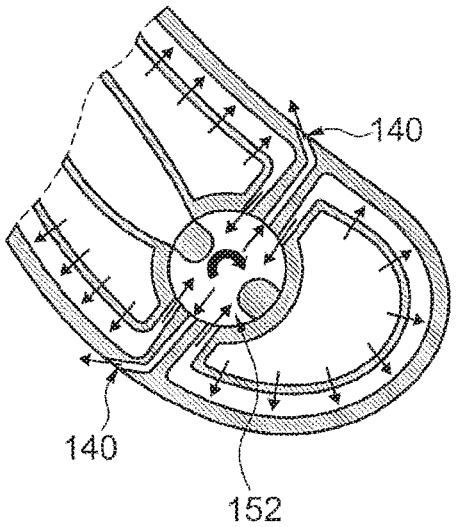
Figure 5:
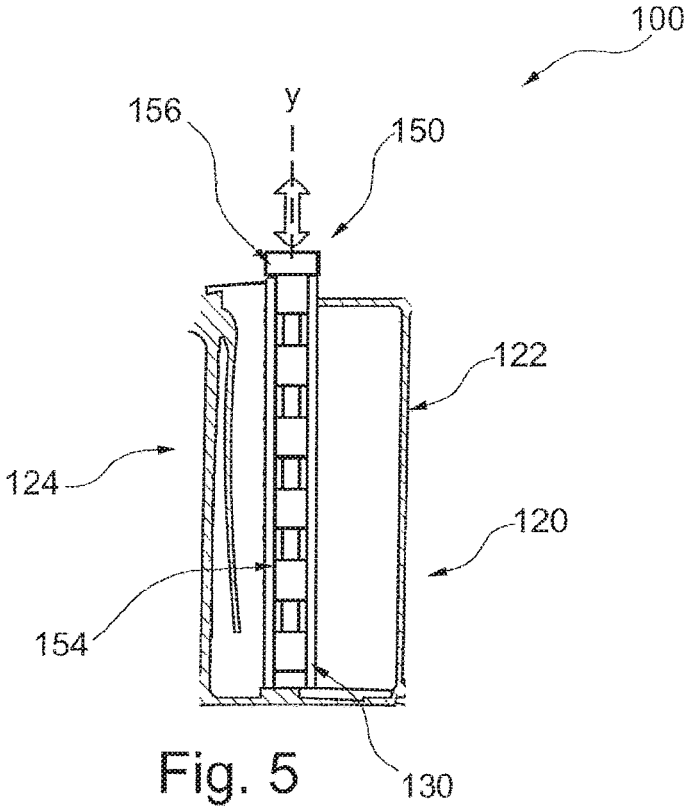
FIG. 5 illustrates an example perspective view of the turbine component with an insert, in accordance with another exemplary embodiment of the present disclosure.

Referring now to FIGS. 1 to 6B, various views of examples of a gas turbine component 100 for forming part of a stage of a gas turbine to be operable to change cooling scheme of cooling air (may be in a film cooling mode and a non-film cooling mode) are disclosed. FIGS. 1A to 1C illustrate examples of various views of the turbine component 100, such as turbine blade or stator vane, having one of an interchangeable connector. FIGS. 2A to 2C illustrates examples of various views of the turbine component 100, having one of another interchangeable connector. The turbine components 100 in FIGS. 3 and 5 illustrate perspective views of the turbine components 100 with various types of inserts (described below), as per various embodiments of the disclosure, whereas FIGS. 4A, 4B, 6A and 6B illustrate various top views of the turbine components 100 with the inserts. The turbine component 100 may be turbine blades, stator vanes or heat shields configured as a whole or as a part of the turbine. However, for the sake of brevity, clarity and to avoid repetition, herein the turbine component 100 will be described with respect to the turbine blades, without departing from the scope of the stator vanes or heat shields or any other turbine components to include the limitations. Further, in as much as the construction and arrangement of the turbine or its turbine components 100 (herein after referred to as "blade 100"), various associated elements may be well-known to those skilled in the art, it is not deemed necessary for purposes of acquiring an understanding of the present disclosure that there be recited herein all of the constructional details and explanation thereof. Rather, it is deemed sufficient to simply note that as shown in FIGS. 1 to 6B, in the blade 100, only those components are shown that are relevant for the description of various embodiments of the present disclosure.

Referring to FIGS. 1A to 2B, the blade 100 includes an airfoil profiled section 120, at least one cooling passageway 130, a plurality of film holes 140, and interchangeable connectors 180, 190. The airfoil profiled section 120 includes a pressure side 122 and a suction side 124 joined together at chordally opposite leading 126 and trailing 128 edges. Further, the cooling passageway 130 is configured to extend between the pressure side 122 and the suction side 124 along the leading edge 126. The cooling passageway 130 is capable of enabling cooling fluid to flow therefrom, which it may receive from a fluid source, such as, the compressor of the engine, or any other source. There may be only one cooling passageway 130, or without departing from the scope of the present disclosure, the blade 100 may configured to include more than one such cooling passageways, as per the requirement.

The blade 100 further includes the plurality of film holes 140 extending between the cooling passageway 130 and an exterior of the airfoil profiled section 120. The plurality of film holes 140 (hereinafter referred to as 'film holes 140') may have a geometric configuration selected from one of a cylindrical, fan and console slot, without departing the scope of other geometric configuration as known in the art. The film holes 140 are capable of directing at least a portion of the cooling fluid from the cooling passageway 130 to flow over a portion of the airfoil profiled section 120 to form an air film cooling layer over the portion of the airfoil profiled section 120 for cooling thereto, and is termed as "the film cooling mode". However, as mentioned above, depending upon different temperature levels; such air film over the portion of the airfoil profiled section 120 may not be required (termed as the non-film cooling mode) and accordingly, the cooling scheme for the blades or vanes may be require to be changed from the film cooling mode to the non-film cooling mode or vice-versa.

For the said objective, as against the prior art, the blade 100 is configured to include the interchangeable connectors 180, 190. The interchangeable connectors 180, 190 are configured to the cooling passageway 130, one at a time. The interchangeable connectors 180, 190 are adapted to change the cooling scheme by changing the flow of the cooling fluid in coordination with the opening and closing of the film holes 140. One of the interchangeable connector 180, as shown in FIGS. 1A to 1C, includes a covering bend 182. The connector 180 with the covering bend 182 is adapted to be secured via a suitable means, such as a sealing arrangement 184, over the cooling passageway 130. However, without departing from the scope of the present disclosure, the connector 180 may be secured by various other suitable means such as, brazing, welding or other mechanical joint. The connector 180 enables at least a portion of the cooling fluid to flow from the leading edge 126 to the trailing edges 128 within an interior portion the airfoil profiled section 120, when the film holes 140 are closed. Further, one of another interchangeable connector 190, as shown in FIGS. 2A to 2C, includes a flat covering member 192 with an orifice 194. The interchangeable connector 190 is adapted to be secured via a suitable means, such as a sealing arrangement 196, over the cooling passageway 130. However, without departing from the scope of the present disclosure, the connector 190, similar to connector 180, may also be secured by various other suitable means such as, brazing, welding or other mechanical joint. The connector 190 enables the cooling fluid from the orifice 194 to flow within the cooling passageway 130. Further, the cooling fluid from the cooling passageway 130 is directed towards the film holes 140 for flowing the cooling fluid to be flow from the leading edge 126 to the trailing edges 128, when the plurality of film holes 140 are opened, to form the film cooling layer extending from the leading edge 126 to the trailing edge 128. The interchangeable connectors 180, 190 are capable of changing the cooling schemes of the cooling fluid, irrespective of film or non-film cooling modes, in the blade 100 upon the requirement depending upon the temperature levels within the turbine.

Referring now to FIGS. 3 to 6B, in various embodiments of the present disclosure, the blade 100 is adapted to include an insert 150. The insert 150 is capable of operably disposed within the cooling passageway 130 in coordination with the interchangeable connectors 180, 190 to at least partially close and open the film holes 140 in conjunction with the change in the cooling scheme. Specifically, in the non-film cooling mode (may be when temperature levels with the turbine is low), the insert 150 is operable to at least partially close the film holes 140 to interrupt the flow of the cooling fluid over the portion of the airfoil profiled section 120. Further, in the film cooling mode (may be when the temperature levels in the turbine is high), the insert 150 is operable to open the film holes 140 to enable the flow of the cooling fluid over the portion of the airfoil profiled section 120 to form the air film cooling layer extending from the leading edge 126 to the trailing edge 128.

In one embodiment, as shown in FIGS. 3, 4A and 4B, the insert 150 may be a cylindrical rotating valve (referred to as numeral '152') adapted to be operable rotatably along an axis 'X' thereof to close and open the film holes 140. As per this embodiment, the cylindrical rotating valve 152 may include through-hole portions 152*a* such that the cylindrical rotating valve 152 is rotated to match and un-match through holes 152*b* of the through-hole portions 152*a* with the film holes 140, respectively, in the film and non-film cooling modes, to open and close the film holes 140 to enable and interrupt the cooling fluid.

Figure 6A:
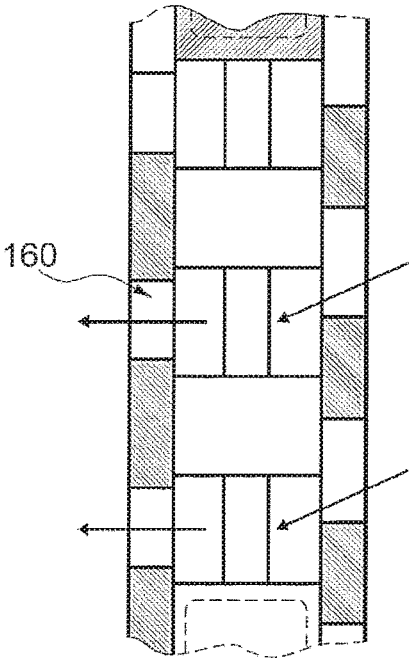
FIGS. 6A and 6B illustrate top views of an inner platform with the insert as per the turbine component of FIG. 5, in accordance with an exemplary embodiment of the present disclosure.
Figure 6B:
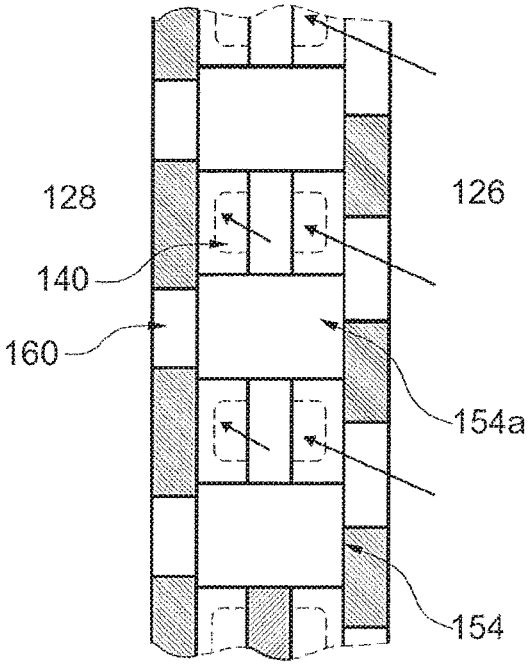

In another embodiment, as shown in FIGS. 5, 6A and 6B, the insert 150 is a cylindrical switch (referred to as numeral '154') adapted to be operable to-and-fro vertically along an axis 'Y' thereof to close and open the film holes 140. The cylindrical switch 154 may include spaced apart fins 154*a* such that the cylindrical switch 154 is operable to-and-fro vertically to enable the fines 154*a* to match and un-match with the plurality of the film holes 140, respectively, to open and close thereto in the film and non-film cooling modes to enable and interrupt the cooling fluid.

In one form, the insert 150, such as the cylindrical rotating valve 152 or the cylindrical switch 154, may be operated manually, such as, to rotate along the axis 'X,' or move to-and-fro vertically along the axis 'Y,' respectively. In another form, the insert 150, such as the cylindrical rotating valve 152 or the cylindrical switch 154, may be operated automatically, such as, to rotate along the axis 'X,' or move to-and-fro vertically along the axis 'Y,' respectively, by one of hydraulic, pneumatic or electrical arrangements. The cylindrical switch 154 may be located within the airfoil profiled section 120, which may be a mechanical switch or a replaceable part with orifices. In manual mode, the cylindrical rotating valve 152 or the cylindrical switch 154 may be accessible after engine disassembly and after disassembly of part, actual for turbine blades or after engine disassembly but without part disassembly, actual for turbine stator vanes. In automatic mode, the cylindrical rotating valve 152 or the cylindrical switch 154 may have active control, such as an element 156, for adapting the part efficiently during operation using remote activator, such as the hydraulic, pneumatic or electromechanical switches, or by using bi-metal devices.

In one further embodiment of the present disclosure, the blade 100 further includes a plurality of trailing through holes 160 configured on the leading edge 126 side in coordination with the cooling passageway 130. The trailing through holes 160 is configured to direct at least the portion of the cooling fluid from the cooling passageway 130 to flow within the interior portion of the airfoil profiled section 120 from the leading 126 to trailing 128 edges for internally cooling of the blade 100 or its airfoil profiled section 120. The plurality of trailing through holes 160 may be closable and openable by the insert 150 upon being operable as described above. The trailing edge 128 may include pin-fin bank 128*a* (as shown in FIGS. 1A and 2A) through which the cooling fluid after cooling the interior portion of the airfoil profiled section 120 may come. Various arrows in FIGS. 4A and 4B indicate direction of the flow of cooling air, without any limitation, by the film holes 140 and the trailing through holes 160. Furthermore, various arrows in FIGS. 6A and 6B, indicate the direction of the flow of the cooling air from the cooling passageway 130 towards the airfoil profiled section 120 by the film holes 140 (FIG. 6B), and the direction of the flow of the cooling air from the cooling passageway 130 towards the trailing through holes 160 (FIG. 6A), for exemplary illustration. Similarly, in FIGS. 1A, 1B, 2A and 2B also indicates the direction of the cooling fluid flow. Such as, without any limitation, the blade 100 may also include an impingement cooling 132, which may receive the cooling fluid from the cooling passageway 130 to cool the leading edge 126. The blade 100 may also include channels 134, which may enables the exit of the cooling fluid from the leading edge 126 and direct the cooling air towards the trailing edge via a plurality of trailing through holes 160 for cooling the trailing edge 128. The plurality of trailing through holes 160 will be described herein later.

In one further embodiment of the present disclosure, the blade 100 may further include plurality fugitive plugs 170 (as shown only in FIG. 4A). The fugitive plugs 170 may be adapted to be plugged in the film holes 140 in the non-film mode to protect the film holes 140 from hot gas injection and oxidation. In one form, the fugitive plugs 170 may be one of a ceramic plugs, metallic plugs, high temperature glue or ceramic plugs, thermal conductive bond coated plugs. In film cooling mode, the fugitive plugs 170 may be removed for opening the film holes 140 by the way of mechanically pressurizing or chemically decomposing, in-situ or remotely.

The gas turbine components 100, such as the turbine blades or stator vanes or any other part such as heat shields, of the present disclosure are advantageous in various scopes. The gas turbine components 100 are optimized to deal with the change in cooling scheme in efficient manner so that required cooling scheme may be obtained easily in an economical and adaptable manner. The interchangeable connectors and the inserts are capable enabling the change of cooling scheme and reversible cooling scheme in economical manner eliminating the requirement of uneconomical castings. Various other advantages and features of the present disclosure are apparent from the above detailed description and appendage claims.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

REFERENCE NUMERAL LIST

100 Gas turbine component
120 Airfoil profiled section
122 Pressure side
124 Suction side
126 Leading edge
128 Trailing edge
128*a* Pin-fin bank
130 Cooling passageway
132 Impingement cooling
134 Channels
140 Plurality of film holes
150 Insert
152 Cylindrical rotating valve (one form of insert 150)
152*a* Through-hole portions
152*b* Through holes
154 Cylindrical switch (another form of insert 150)
154*a* Fins
156 Element
160 Plurality of trailing through holes
170 Plurality fugitive plugs
180, 190 Interchangeable connectors
182 Covering bend
184 Sealing arrangement
192 Flat covering member
194 Orifice
196 Sealing arrangement

What is claimed is:

1. A kit for a modifiable gas turbine component to change a cooling scheme thereof, the gas turbine component for forming part of a stage of a gas turbine, the kit comprising:

an airfoil profiled section having a pressure side and a suction side joined together at chordally opposite leading and trailing edges;

at least one cooling passageway extending between the pressure side and the suction side along the leading edge, the at least one cooling passageway capable of enabling cooling fluid to flow therefrom, the at least one cooling passageway including first and second passageways, the first and second passageways each having an opening at a radial end of the gas turbine component;

a plurality of film holes extending between the at least one cooling passageway and an exterior of the airfoil profiled section, the plurality of film holes capable of directing at least a portion of the cooling fluid from the at least one cooling passageway to flow over a portion of the airfoil profiled section; and interchangeable connectors, each configured to be secured to the radial end over the openings of the first and second passageways, wherein a second of the interchangeable connectors selectively secured to the radial end changes the cooling scheme relative to a first of the interchangeable connectors selectively secured to the radial end by changing the flow of the cooling fluid in coordination with the opening and closing of the plurality of film holes.

2. The kit for the modifiable gas turbine component as claimed in claim 1, wherein the first interchangeable connector comprises a covering bend adapted to enable at least a portion of the cooling fluid to flow from the leading edge via the first passageway into the second passageway and to the trailing edges within an interior portion the airfoil profiled section, when the plurality of film holes are closed.

3. The kit for the modifiable gas turbine component as claimed in claim 1, wherein the second interchangeable connector comprises a flat covering member with an orifice, to enable the cooling fluid from the orifice to flow within the second passageway, and to enable the cooling fluid from the first passageway to be directed out of the plurality of film holes, and externally along the airfoil profiled section from the leading edge to the trailing edges, when the plurality of film holes are opened, to form a film cooling layer extending from the leading edge to the trailing edge.

4. The kit for the modifiable gas turbine component as claimed in claim 1 further comprising:

an insert operably disposed within the at least one cooling passageway in coordination with the interchangeable connectors, to at least partially close and open the plurality of film holes in conjunction with the change in the cooling scheme.

5. The kit for the modifiable gas turbine component as claimed in claim 4, wherein the insert is operable to at least partially close the plurality of film holes to interrupt the flow of the cooling fluid over a portion of the airfoil profiled section and direct the flow of the cooling fluid to flow from the leading edge to the trailing edges within the airfoil profiled section.

6. The kit for the modifiable gas turbine component as claimed in claim 5, wherein the insert is operable to open the plurality of film holes to enable the flow of the cooling fluid externally over the portion of the airfoil profiled section to form a film cooling layer extending from the leading edge to the trailing edge.

7. The kit for the modifiable gas turbine component as claimed in claim 4, wherein the insert is a cylindrical rotating valve adapted to be operable rotatably along an axis thereof to close and open the plurality of film holes.

8. The kit for the modifiable gas turbine component as claimed in claim 7, wherein the cylindrical rotating valve comprises through-hole portions such that the cylindrical rotating valve is rotated to match and un-match through holes of the through-hole portions with the plurality of film holes respectively to open and close the plurality of film holes to enable and interrupt the cooling fluid.

9. The kit for the modifiable gas turbine component as claimed in claim 4, wherein the insert is a cylindrical switch adapted to be operable to-and-fro vertically along an axis thereof to close and open the plurality of film holes.

10. The kit for the modifiable gas turbine component as claimed in claim 9, wherein the cylindrical switch comprises spaced apart fins such that the cylindrical switch is operable to-and-fro vertically to enable the fines to match and unmatch with the plurality of film holes respectively to enable and interrupt the cooling fluid.

11. The kit for the modifiable gas turbine component as claimed in claim 4, wherein the insert is operable manually.

12. The kit for the modifiable gas turbine component as claimed in claim 4, the insert is operable automatically by one of hydraulic, pneumatic or electrical arrangements.

13. The kit for the modifiable gas turbine component as claimed in claim 1, wherein the plurality of film holes comprises of geometric configuration selected from one of a cylindrical, fan and slot.

14. The kit for the modifiable gas turbine component as claimed in claim 1, further comprising a plurality of trailing through holes configured on the leading edge side in coordination with the at least one cooling passageway to direct at least the portion of the cooling fluid from the at least one cooling passageway to flow within the interior portion of the airfoil profiled section from the leading to trailing edges.

15. The kit for the modifiable gas turbine component as claimed in claim 14, the plurality of trailing through holes is closable and openable by operation of the insert.

16. The kit for the modifiable gas turbine component as claimed in claim 1, further comprising a plurality fugitive plugs adapted to be plugged in the plurality of film holes to close the plurality of film holes.

17. The kit for the modifiable gas turbine component as claimed in claim 16, wherein the plurality fugitive plugs include at least one of ceramic plugs, metallic plugs, high temperature glue or ceramic plugs, and thermal conductive bond coated plugs.

* * * * *